United States Patent [19]

Booth

[11] 4,136,773

[45] Jan. 30, 1979

[54] CONTAINER FOR ARTIST'S CRAYONS

[76] Inventor: Darcy L. Booth, 12040 E. Ranchito St., El Monte, Calif. 91732

[21] Appl. No.: 799,494

[22] Filed: May 23, 1977

Related U.S. Application Data

[63] Continuation-in-part of Ser. No. 648,256, Jan. 12, 1976, abandoned.

[51] Int. Cl.[2] ..... B65D 85/28; B65D 25/10

[52] U.S. Cl. ..... 206/214; 206/45.16; 206/507; 211/69; 220/408

[58] Field of Search ..... 206/214, 45.16, 507, 206/45.19; 211/69, 69.1; 220/93, 17

[56] References Cited

U.S. PATENT DOCUMENTS

| | | | |
|---|---|---|---|
| 540,268 | 6/1895 | Newell | 211/69 |
| 1,015,455 | 1/1912 | Neesham | 206/45.16 |
| 1,104,650 | 7/1914 | Fries | 211/69 |
| 2,266,001 | 12/1941 | Christianson | 220/93 |
| 2,496,758 | 2/1950 | Tingley | 211/69 |
| 2,637,299 | 5/1953 | Salkey | 206/214 |
| 3,420,402 | 1/1969 | Frater et al. | 206/507 |
| 3,727,771 | 4/1973 | Hoffman | 211/69 |

*Primary Examiner*—William T. Dixson, Jr.

*Attorney, Agent, or Firm*—Boniard I. Brown

[57] ABSTRACT

An upwardly open box is provided with an inset cover of substantial thickness perforated by a plurality of orifices adapted in size and spacing to the reception and retention of artist's crayons. The peripheral wall of the box, generally rectangular in plan, extends above the upper surface of the inset cover and protects the protruding ends of the crayons against breakage. The vertical location of the cover within the box is variable to accommodate to the changing length of the crayons with wear, by manually adjustable means including projections and recesses for removably securing the inset cover or holder plate in selected vertical positions relative to the box. The manually adjustable means may comprise mechanical means removably securing the inset cover or plate relative to the side walls by means of adjustment elements having cam projection means engageable in slot recesses, or the manually adjustable means may comprise interengageable projections and recesses on the box end walls and on the inset cover or plate, so configurated and arranged that with the inset or holder plate in one endwise position it is supported at one height, and with the cover or plate in a second endwise position then plate is supported at a second height relative to the box.

23 Claims, 13 Drawing Figures

10
12
14
20
22
30a
30b
100
2
2

10
14
20a
20b
20c
12
100
30a
36
22
30b
34
16
32a
32b 30
36
34

121
112
122
20
10

200
214
210
222
LONG
SHORT
212
213
211

CONTAINER FOR ARTIST'S CRAYONS

RELATED APPLICATIONS

This application is a continuation-in-part of application Ser. No. 648,256 filed Jan. 12, 1976 now abandoned.

BACKGROUND OF THE INVENTION

1. Field of the Invention

The invention relates to a container for crayons. It relates, more particularly, to such a container wherein wax crayons may be stored in an organized manner and protected from breakage and abrasion.

2. Discussion of the Prior Art

Wax crayons are widely used in the field of art; the most common uses range from the encouragement of creative expression at the kindergarten level of schools to finished, and highly sophisticated work in commercial art.

A common failing of such crayons is their fragility, inherent in the waxy matrix in which the coloring dies are dispersed. Furthermore, such crayons readily smudge each other and the container they are stored in with deleterious effect on the cleanliness of the finished work and of the user's hands.

Another factor of some importance in the use of wax crayons lies in the large number which must be employed in artwork of any sophistication. Crayons are used to deposit a layer of waxy substance on the substrate — paper, cardboard, linen, etc. — and the colors cannot be blended in the manner common to oil and water based paints. Consequently, a crayon must be available, and readily accessible, for each hue which is to be present in the finished work.

In view of the above considerations the containers provided by the prior art, in the main restricted to the paper and plastic boxes and cartons in which the crayons are sold, do not meet the requirements of a serious user of such crayons. Such containers fail to protect the crayons from breakage and mutual abrasion and rarely provide ready access to a particular color, so that the user must finger his way through a number of crayons to find the one desired.

It is, therefore, the primary object of the invention to provide a container for artist's crayons which provides for individual storage locations for a plurality of such articles, with each one readily accessible to the user.

It is a further object of the invention to provide such a container in which the individual crayons are firmly secured in their storage locations and protected from breakage and abrasion.

It is an object of the invention to provide such a container wherein manually adjustable means permit the cover or holder plate to be secured in selected vertical positions relative to the base of the box so that crayons of varying length may be accommodated.

It is yet another object of the invention to provide adjustment means operating on some, or all, of the storage locations for individual crayons, so that protection of such crayons and ready access to them shall be maintainable for crayons worn down from their original lengths.

It is also an object of the invention to provide such storage containerw wherein crayons are so engaged in holder orifices that the crayons are retained when the box and holder are inverted.

It is also an object of the invention to provide such storage containers in a form readily and economically produced.

SUMMARY OF THE INVENTION

The aforementioned objects of the invention, and other objects and advantages which shall become apparent from the detailed description of the preferred embodiment thereof below, are attained in assembly including a rectangular box with a perforated cover of some thickness. The perforations in the cover correspond in diameter to the outer surface of the wax crayons to be stored in the container in such a manner that crayons may readily be slipped into such perforations and removed therefrom.

In the preferred embodiment of the invention the cover is made of a resilient plastic composition and a slight interference fit, of the order known as a "slip fit" in the mechanical arts, is established between the inner surface of the perforations and the outer surface, usually represented by a protective paper sleeve, of the crayons.

The base of the box is spaced from the lower surface of the cover to the extent that a crayon secured in the perforations thereof may be pushed downward into contact with the base and still protrude above the upper surface of the cover to a sufficient distance to be readily grasped and pulled from its storage location.

The peripheral walls of the box are elevated above the upper surface of the cover, so that the protruding ends of the crayons are protected from accidental contact by the user or an external object and, thereby, from mechanical damage.

The spacing of the individual orifices in the cover plate is arranged to permit ready insertion and removal of individual crayons, and sufficient visibility to admit of ready recognition of the several colors and shades.

The adjustment means allowing for worn crayons to be stored in the container either permit the cover plate to be secured in alternate vertical positions with respect to the base of the box or that base may be provided with two or more adjacent levels, so that crayons of varying length may be catered to by insertion into a vertical storage slot of the appropriate height. A combination of the above methods is also possible, with the container subdivided into a plurality of compartments with one, or more, of these compartments having vertically movable orifice plates and the other, or others, provided with such plates at a fixed distance above the box base.

Guide means to facilitate the insertion of crayons into the individual orifices of the cover plate may also be provided. One form of such guide means takes the provision of a conically expanding upper portion of the orifice itself, thereby allowing some angular and/or spatial misalignment of the crayon at the instant of presentation to the orifice.

BRIEF DESCRIPTION OF THE DRAWINGS

The preferred embodiment of the invention is illustrated in the accompanying drawing and described with reference to the several figures thereof, wherein.

DESCRIPTION OF THE PREFERRED EMBODIMENT

Figure 1:
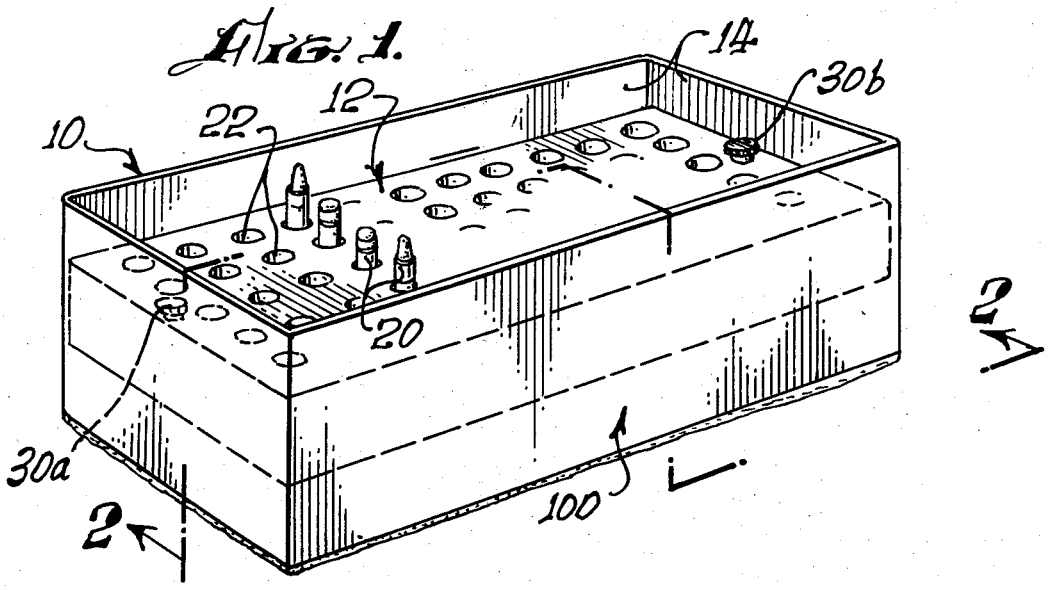
FIG. 1 is a perspective view of a crayon storage container of the invention with a single, vertically adjustable, cover plate and provision for the retention of sixty cylindrical crayons.

The perspective view of FIG. 1 shows a crayon container 100 whose basic elements are represented by an upwardly open box 10 and a perforated holder plate or cover 12. The cover 12 is inset into the box 10 in such a manner that the periphery of the latter forms a palisade 14 protectively surrounding the protruding ends of crayons 20 seated in orifices 22 passing through the thickness of the cover 12. Between the bottom of the box 10 and the base of the cover 12 there is a vertical space 16 into which the bases of the several crayons 20 intrude.

Figure 2:
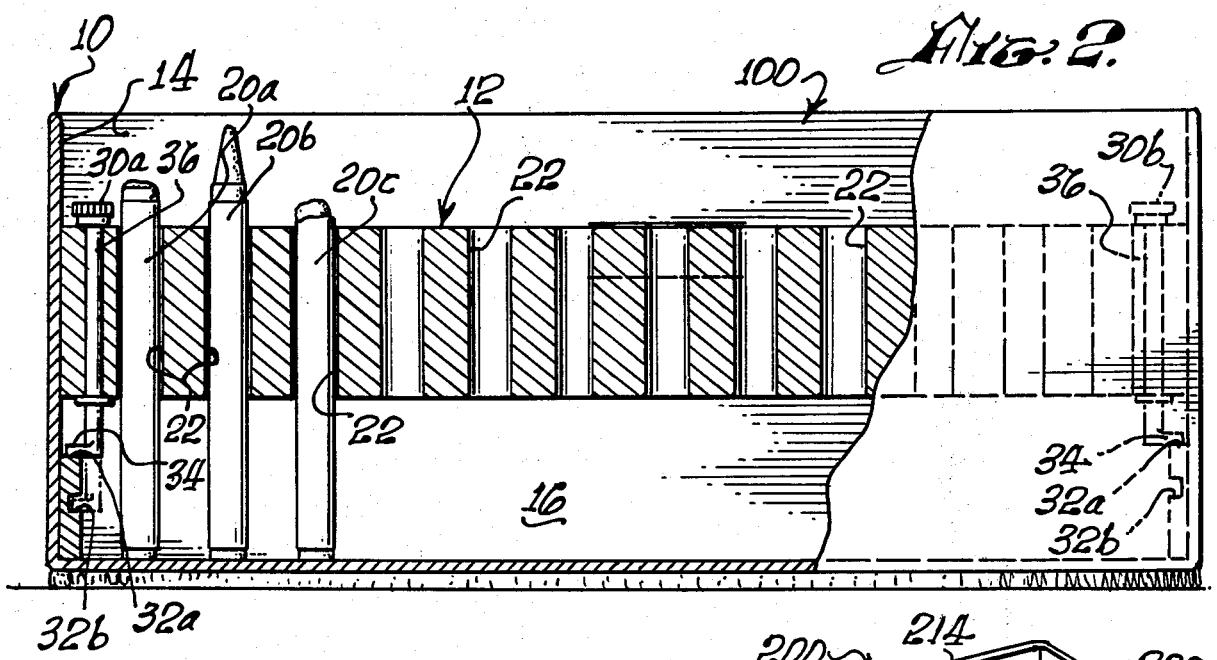
FIG. 2 is a partial transverse section through the embodiment of FIG. 1 taken along section line 2—2 therein, illustrating the detailed construction of the container and the adjusting mechanism for the perforated cover.

A transverse partial section of the container 100 is provided in FIG. 2. Typical wax crayons 20*a*, 20*b*, and 20*c* are shown passing through orifices 22. The embodiment of the container of the invention illustrated in FIGS. 1 and 2 provides for the storage of sixty crayons in a rectangular array of five rows of twelve storage locations each; the number of such locations and their spatial arrangement, as well as the platform of the container are matters of choice for a given purpose, but the preferred form of the invention will provide for at least two dozen storage locations, suitably in a rectangular array.

The orifices 22 are drilled through, or molded into, the thickness of the cover 12 which is preferably made of a translucent or opaque plastic composition, in contrast to the box 12 which is preferably of a transparent plastic, although other materials and transparencies may be of a translucent or opaque plastic composition, in contrast to the box 12 which is preferably of a transparent plastic, although other materials and transparencies may be readily utilized without departing from the teachings herein.

The orifices 22 are arranged to have a cross-section slightly larger than the corresponding external dimension of the crayons 20, so that a slip fit is developed upon the insertion of a crayon into an orifice and helps to retain the former in the container even if the latter should become inverted.

Since crayons deposit part of their physical substance in use, their length will shorten with time. The container 100 is, therefore, arranged in such a manner that as the complement of crayons stored within wears, the relative elevation of the cover 12 with respect to the base of the box 10 may be altered.

To secure such an adjustment the cover 12 is arranged to be a sliding fit in the internal contour of the box 10 and to be supported above the base thereof by means of two cam projections 34 on adjustment elements arranged at either end of the box on a line bisecting its width. The cams or projections 34 are molded integrally with an elongated cylindrical shank 36 each, with the latter secured in vertical bores passing through the cover 12. Adjusting and lifting knobs 30*a* and 30*b* are attached to the upper ends of the shanks 36 and permit the rotation of the cams 34 from above the surface of the cover plate.

Support slots or recesses, adapted to be engaged by the cams 34, are also provided in the end walls of the box 10, two such slot recesses 32*a* and 32*b* are shown in the container 100 and permit the locking of the cover plate 12 at two distinct elevations in the box 10.

Figure 3:
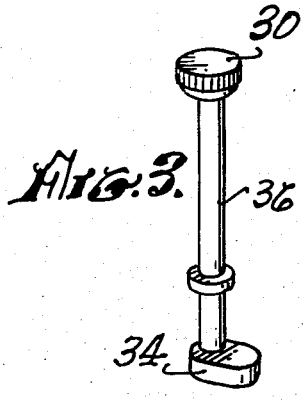
FIG. 3 is a detail of the embodiment of FIG. 1, showing, in perspective, the conformation of the adjusting cam thereof.

FIG. 3 is a detail view, in perspective, of a typical adjusting assembly, including a knob 30, a shank 36 and cam 34.

Figure 4:
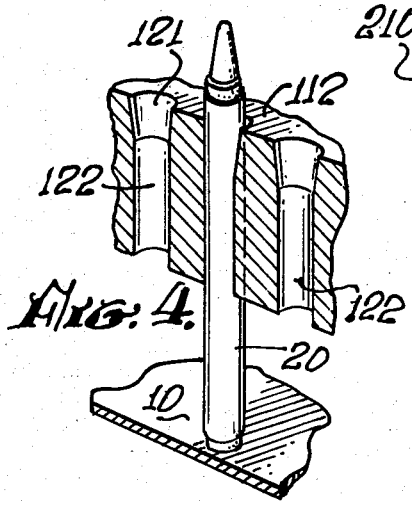
FIG. 4 is a fragmentary section in perspective of an alternative embodiment of the cover plate of the container of the invention, illustrating the use of a conical entry guide therein.

FIG. 4 is an alternative embodiment 112 of the cover plate of the crayon organizer of the invention. The major difference with respect to the part 12, with which the cover plate 112 is fully interchangeable, is the provision of a frustro-conical entry 121 in the upper ends of the orifices 122 passing through the cover 112, to facilitate the entry of individual crayons 20 thereinto.

Figure 5:
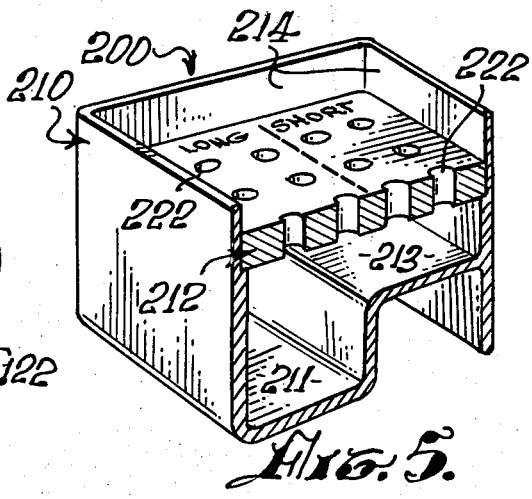
FIG. 5 is a partial, sectioned, perspective view of an alternative embodiment of the crayon receptacle of the invention, provided with a fixed cover plate and a two-level base, for the accommodation of crayons of differing lengths.

The sectioned perspective view of FIG. 5 shows a further embodiment 200 of the crayon container of the invention. The container 200 is particularly adapted for the use of commercial artists where the rate of wear is so high for certain commonly used colors that, with time, the user may expect a completely random mix of relatively new and relatively old crayons. Because of the difficulty of accommodating such crayons in containers which are either non-adjustable in the elevation of the cover plate or in which the adjustment of necessity involves the entire cover, the container 200 is provided with a single, non-adjustable cover 212 inset into a box 210 in such a manner that a peripheral wall 214 protrudes above the upper plane of the cover and protects the crayons from mechanical damage, once stored in one of the orifices 222 passing through the cover plate 212.

The base of the box 210 is molded in two sections 211 and 213 to such an effect that the section 213 is higher in elevation than the adjacent section 211. The cover 212 is suitably marked into two areas overlying the sections 211 and 213, respectively, so that the user is clearly directed to place long crayons into orifices 222 above section 211, and shorter crayons into similar orifices underlain by section 213.

By such means it is possible to store crayons in a safe and readily organized manner regardless of the extent of wear of any individual coloring stick.

While not specifically illustrated, it will be readily understood that embodiments analogous to container 200 may be provided with more than two levels of support base sections, and that they may be combined with compartments in which the cover is movable, in the manner of the container 100 described above.

FIGS. 6 through 11 illustrate another form of manually adjustable mechanical means for positioning the holder plate at selected heights relative to the box. A box 310 is similar to that of the form of FIGS. 1 and 2, the box having side walls 314, 316 and having a first end wall 318, a second end wall 320, and a bottom wall 321, and a holder plate 312 is generally similar to that of the form of the invention shown in FIGS. 1 and 2 except as hereafter described. Extending inwardly from the first box end wall 318 are relatively high rectilinear projections 322, 324 having upper edge surfaces 326, 328, respectively, and relatively lower rectilinear projections 330, 332 having respective upper edge surfaces 334, 336. Extending inwardly from the second box end wall are similar projections, but in an array which is the reverse of those extending from the first end wall, as shown. Relatively high projections 338, 340 have respective upper edge surfaces 342, 344, and relatively lower rectilinear projections 346, 348 have upper edge surfaces 350, 352, respectively.

Figures 6, 7, 8, 9, 10, 11, 12, 13:
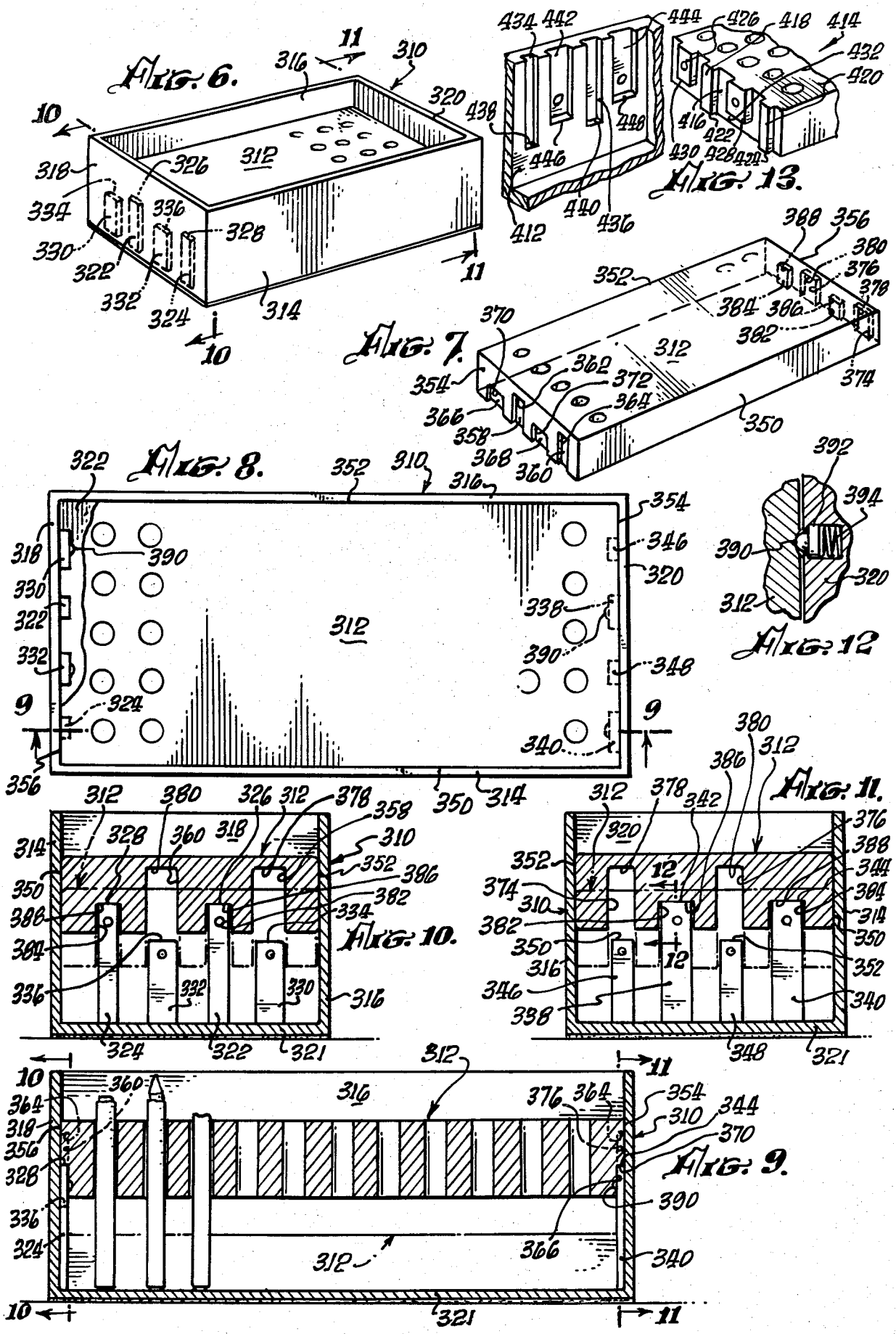
FIGS. 6 and 7 are perspective views of the container box and holding plate or insert of another form of crayon storage container of the invention, and showing interengaging projections and recesses utilized in selectively adjusting the height of the holder plate.
FIG. 8 is a plan view of the crayon storage container of FIGS. 6 and 7.
FIG. 9 is a transverse sectional view taken at line 9—9 in FIG. 8.
FIG. 10 is a sectional view taken at line 10—10 in FIG. 6 and in FIG. 9, showing the interengagement of projections and recesses on the respective components for supporting the holder plate.
FIG. 11 is a sectional view taken at line 11—11 in FIGS. 6 and 9.
FIG. 12 is a fragmentary sectional view taken at line 12—12 in FIG. 11, showing a form of detent which may be utilized with the invention.
FIG. 13 is a fragmentary, exploded perspective view of a modified form of the crayon storage container invention of FIGS. 6 through 11.

Referring to FIG. 7, holder plate 312 has side surfaces 350, 352, a first end surface 354 and a second end surface 356. Defined in the first end surface 354 are relatively high rectilinear recesses 358, 360, having respective upper seating surfaces 362, 364, and defined in this surface are relatively lower rectilinear recesses 366, 368 having respective upper seating surfaces 370, 372.

Defined in second end surface 356 are similar recesses in reverse array from the recesses in the first end surface, as shown, these comprising relatively high recesses 374, 376 having upper seating surfaces 378, 380, and relatively lower recesses 382, 384 having upper seating surfaces 386, 388.

The projections on the box end walls and the recesses in the holder plate end surfaces are interengageable so that with the holder plate inserted in the box, as shown in FIGS. 9–11, the holder plate is supported by the seating of recess seating surfaces on the upper edge surfaces of the higher projections, it will be understood from the geometry of the parts that with the first end surface 354 of the holder plate positioned adjacent the first box end wall 318, the holder is supported in the lower position shown in phantom outline in FIGS. 10 and 11 with the upper seating surfaces 362, 364 of the respective recesses 358, 360 seating upon upper edge surfaces 326, 328, respectively, of higher projections 322, 324. As shown and as will be understood from the geometry of the parts, with the first end surface 54 of holder plate 312, with the removable holder plate 312 positioned in the reverse orientation, with its first end surface 354 adjacent the second end wall 320 of the box, the holder plate is supported in its higher position with the upper supporting seating surface 370, 372 of respective recesses 366, 368 supported on upper edge surfaces 344, 342, respectively, of the higher projections 338, 340. Thus, it will be understood from the foregoing that the holder plate may be manually positioned, by means of the mechanical adjustment means provided by the projections and the recesses, thus selectively to position the holder plate in a higher or lower position, in accordance with the length of crayons carried by the holder plate and supported on the bottom of the box.

A plurality of detent means 390 may preferably be provided between the projections and the recesses walls for the releasible retention and securement of the holder plate 312 relative to the box 310. The detent means may be of the type shown in FIG. 12, comprising a plunger element 392 in an appropriate opening and resiliently urged by a spring 394, or it may be a resilient plastic insert element or button.

A modified form of the projection-and-recess mechanical means for selectively adjusting the position of the holder plate, is shown in the fragmentary perspective view of FIG. 13. In the modified form, projections extend from the end surface of the holder plate and recesses are defined in the end walls of the box. FIG. 13 shows fragmentary portions of a box 410 including a first end wall 412, in which are defined recesses, and a portion of a holder plate 414 from a first end surface 416 of which projections extend. Longer or higher projections 418, 420 have edge surfaces 422, 424, respectively, and shorter projections 426, 428, have seating surfaces 430, 432, respectively. The opposite or second end of the plate (not shown) has similar projections in reverse array. The recesses in box wall 412 include longer recessed 434, 436 having seating surfaces 438, 440, respectively, and shorter recesses 442, 444 having seating surfaces 446, 448, which recesses are engageable with the projections of the holder plate. It will be understood from the geometry of the parts that, with the projections shown on the first end surface of the holder engaged in the recesses of the first box end wall shown, the holder will be supported in a lower position, with the end surfaces 430, 432 of projections 426, 420, respectively, seating against the seating surfaces 438, 440 of recesses 434, 436, respectively. It will be further understood that with the projections extending from the second end surface (not shown) of the holder engaged in the recesses shown in the box first end wall 412, the lower edge surfaces of the longer projections rest on the seating surfaces 446, 448 of shorter recesses 442, 444 to support the holder in its higher position.

The inventor claims:

1. A container and organizer for crayons, comprising:

an upwardly open box defined by bottom and side walls, a removable holder plate configurated to fit within the side walls and defining a plurality of orifices sized to receive the crayons, means removably securing the holder plate in a normally horizontal position in selected positions at different heights relative to the normally vertical side walls wherein the crayons extend downwardly to be supported by the bottom and extend upwardly above the holder plate, said securing means including recess and projection means interengaging the holder plate and the box, and said securing means being manually operable to releasibly position the holder plate at selected respective heights relative to the box side walls.

2. A container and organizer for crayons according to claim 1 and further including:

resilient detent means between the holder plate and the box walls releasibly to secure the holder plate relative to the box.

3. A container and organizer for crayons according to claim 1 wherein:

said side walls extend above the holder plate to provide a protective palisade to protect the upper portions of the crayons against impact breakage.

4. A container and organizer for crayons according to claim 1 wherein:

the respective orifices are sized to receive respective crayons with an interference fit.

5. A container and organizer for crayons, comprising:

an upwardly open box having a bottom, normally vertical side walls, and first and second end walls, a removable holder plate configurated to fit within the side walls in either a first endwise position or a second endwise position, said holder plate having first and second end surfaces and defining a plurality of orifices sized to receive the crayons, interengageable projections and recesses on the box end walls and on the holder plate end surfaces, the respective projections at each end having respective heights, said projections and recesses and their respective heights being so configurated and arranged that with the holder plate in said first endwise position it is supported at a first height and with the holder plate in said second endwise position it is supported at a second height relative to the box.

6. A container and organizer for crayons according to claim 5 and further including:

resilient detent means between the holder plate and the box walls releasibly to secure the holder plate relative to the box.

7. A container and organizer for crayons according to claim 5 wherein:

said side walls extend above the holder plate to provide a protective palisade to protect the upper portions of the crayons against impact breakage.

8. A container and organizer for crayons according to claim 5 wherein:

the respective orifices are sized to receive respective crayons with an interference fit.

9. A container and organizer for crayons according to claim 5 and further including:

at least one relatively high normally vertical rectilinear projection extending outwardly from the inner surface of each of said box end walls, each of the projections having an upper edge surface, and at least one relatively high rectilinear recess and at least one relatively low rectilinear recess defined at each of said first and second end surfaces of the holder plate, each of the recesses having an upper seating surface, said projections and recesses and their respective heights being so configurated and arranged that with the holder plate positioned with its first end surface adjacent the first box end wall the upper seating surfaces of the higher recesses are supported on the upper edge surface of at least one of the higher projections to support the holder plate at a lower level position relative to the box, and with the holder plate positioned with its first end surface adjacent the second box end wall, the upper seating surfaces of the lower recesses are supported on the upper end surfaces of the higher projections to support the holder plate in a higher level position relative to the box.

10. A container and organizer for crayons according to claim 9 and further including:

resilient detent means between the holder plate and the box walls releasibly to secure the holder plate relative to the box.

11. A container and organizer for crayons according to claim 9 wherein:

said side walls extend above the holder plate to provide a protective palisade to protect the upper portions of the crayons against impact breakage.

12. A container and organizer for crayons according to claim 9 wherein:

the respective orifices are sized to receive respective crayons with an interference fit.

13. A container and organizer for crayons according to claim 5 and further including:

at least one relatively long normally vertical rectilinear projection and at least one relatively short normally vertical rectilinear projection extending outwardly from each of the end surfaces of the holder plate, each of the projections having an edge surface, at least one relatively deep recess and at least one relatively short recess extending outwardly from the inner surface of each of the box end walls, each of the recesses having a seating surface, said projections and recesses and their respective lengths and depths being so configurated and arranged that with the holder plate positioned with its first end surface adjacent the first box end wall the edge surfaces of the projections are supported on the seating surface of at least one of the deeper recesses to support the holder plate at a lower level position relative to the box, and with the holder plate positioned with its first end surface adjacent the second box end wall, the edge surface of at least one of the projections is supported on the seating surface of the shorter recess to support the holder plate in a higher level position.

14. A container and organizer for crayons according to claim 13 and further including:

resilient detent means between the holder plate and the box walls releasibly to secure the holder plate relative to the box.

15. A container and organizer for crayons according to claim 13 wherein:

said side walls extend above the holder plate to provide a protective palisade to protect the upper portions of the crayons against impact breakage.

16. A container and organizer for crayons according to claim 13 wherein:

the respective orifices are sized to receive respective crayons with an interference fit.

17. A container and organizer for crayons, comprising:

an upwardly open box defined by bottom and normally vertical side walls, a removable holder plate configurated to fit within the side walls and defining a plurality of orifices sized to receive the crayons, and manually adjustable mechanical interengaging means including projections and recesses for removably securing the holder plate in a normally horizontal position relative to the normally vertical side walls wherein the crayons extend downwardly to be supported by the bottom and extend upwardly above the holder plate, the side walls extending about the box circumference and a substantially uniform distance above said horizontal holder plate to provide a protective palisade to protect the upper portions of the crayons against impact breakage.

18. A crayon container according to claim 17 wherein said holder plate securing means comprises:

at least one manually rotatable mechanical adjustment element on the holder plate for selectively positioning the plate in selected positions relative to the side walls and for supporting the plate by cam projection means in selected positions.

19. A crayon container according to claim 17 wherein:

the respective orifices are sized to receive respective crayons with an interference fit.

20. A crayon container according to claim 17 wherein:

frustro-conical guide portions are defined in the upper portions of the orifices for alignment of the crayons during insertion therein.

21. A crayon container according to claim 17 wherein:

said bottom comprises basal sections at at least two positions relative to the side walls for supporting crayons of differing respective lengths with portions thereof extending above the holder plate.

22. A crayon container according to claim 19 and further including:

resilient seal means between respective crayons and their respective orifices.

23. A container and organizer for crayons, comprising:

an upwardly open box defined by bottom and side walls, a removable holder configurated to fit within the side walls and defining a plurality of orifices sized to receive the crayons, the side walls extending above the holder plate to provide a protective palisade to protect the upper portions of the crayons against impact breakage, means removably securing the holder plate in a position relative to the side walls wherein the crayons extend downwardly to be supported by the bottom and extend upwardly above the holder plate, said means removably securing the holder plate, comprising means defining a plurality of spaced slot recesses on the side walls, and a pair of adjustment elements rotatably mounted at spaced locations in the holder plate, each of the adjustment elements having a knob above the holder plate for manual grasping and having a cam projection below the plate positioned and adapted for engagement with said slot recesses, whereby upon manual rotation of the knobs of the adjustment elements, the cam projections thereof may be engaged in selected slots to support the holder plate in selected positions relative to the side walls, the cams may be disengaged from the slots and the holder plate may be adjusted in position and removed by means of the knobs.

* * * * *